US007014438B2

(12) United States Patent
Fukuda et al.

(10) Patent No.: US 7,014,438 B2
(45) Date of Patent: Mar. 21, 2006

(54) FLUID MACHINERY

(75) Inventors: Takashi Fukuda, Shizuoka-Ken (JP); Takayoshi Fujiwara, Kanagawa-Ken (JP); Masayuki Okuda, Kanagawa-Ken (JP); Takuya Hirayama, Kanagawa-Ken (JP); Satoshi Oyama, Shizuoka-Ken (JP)

(73) Assignee: Toshiba Carrier Corporation, Tokyo (JP)

( * ) Notice: Subject to any disclaimer, the term of this patent is extended or adjusted under 35 U.S.C. 154(b) by 0 days.

(21) Appl. No.: 10/732,811

(22) Filed: Dec. 11, 2003

(65) Prior Publication Data

US 2004/0151610 A1 Aug. 5, 2004

(30) Foreign Application Priority Data

Dec. 12, 2002 (JP) ..... 2002-361142

(51) Int. Cl.
*F01C 21/08* (2006.01)
*F03C 2/00* (2006.01)

(52) U.S. Cl. ..... 418/220; 418/178; 418/179

(58) Field of Classification Search ..... 418/220, 418/178, 179
See application file for complete search history.

(56) References Cited

U.S. PATENT DOCUMENTS

| | | | | |
|---|---|---|---|---|
| 5,314,321 | A * | 5/1994 | Yamamoto et al. | 418/178 |
| 5,573,390 | A * | 11/1996 | Takeuchi et al. | 418/178 |
| 6,142,755 | A * | 11/2000 | Shiinoki et al. | 418/178 |
| 6,354,825 | B1 * | 3/2002 | Fujiwara et al. | 418/220 |

FOREIGN PATENT DOCUMENTS

| | | | |
|---|---|---|---|
| JP | 62199982 | A * | 9/1987 |
| JP | 02201072 | A * | 8/1990 |
| JP | 02291491 | A * | 12/1990 |
| JP | 7-247966 | | 9/1995 |
| JP | 08276451 | A * | 10/1996 |
| JP | 2000-314383 | | 11/2000 |

* cited by examiner

*Primary Examiner*—Theresa Trieu
(74) *Attorney, Agent, or Firm*—Pillsbury Winthrop Shaw PIttman LLP

(57) ABSTRACT

A fluid machinery such as helical compressor includes a sliding mechanism comprising one side member composed, in combination, of a metallic base member having a sliding surface and a lubrication film formed on the sliding surface in a close contact thereto, and a counterpart side member containing fluorocarbon resin in an amount of at least 50 wt. %. The lubrication film includes a solid lubricant having a self-lubrication property and a binder of resin material.

13 Claims, 6 Drawing Sheets

FLUID MACHINERY

BACKGROUND OF THE INVENTION

1. Field of the Invention

The present invention relates a fluid machinery and more particularly, a fluid pressure apparatus such as fluid compressor, which is especially provided with an improved sliding mechanism.

2. Related Art

With respect to material for forming a sliding mechanism of a fluid machinery such as a compressor or a vacuum pump, there have conventionally been utilized either combination of resin including fluorocarbon resin with metallic material or such metallic material subjected to a hard surface treatment, or combination of the above-mentioned resin with ceramics having a high hardness.

The above-mentioned material combination for the sliding mechanism is significant for performance of the fluid machinery. There have been recognized many cases in which the above-mentioned material combination was applied to a part of a movable sealing unit, which was to be moved in a state contacting a component of the fluid machinery to provide a sealing function.

Such a sliding mechanism or sealing unit has been normally used in a non-lubricant supply type fluid machinery or apparatus to which lubricant oil is not specifically supplied, as shown in Japanese Laid-Open Patent Publication No. H7-247966 and Japanese Laid-Open Patent Publication No. 2000-314383.

In general, it is difficult in actuality to cause the sliding surface of the sliding mechanism to be coincident completely geometrically with a surface of a counterpart at a initial stage of the sliding motion. As a result, the sliding surface of the sliding mechanism repeats the behavior of getting close to the surface of the counterpart, sliding thereon and getting away therefrom, thus causing an extremely complicated motion.

Consequently, in the conventional structure in which a direct sliding motion between the resin member and the metallic member (or something with a hard surface, which has the hardness similar to or larger than metallic member) occurs, the contact surface pressure may increase locally, especially at the initial stage of the compression operation, with the result that the metallic member abrades the resin member, leading to a serious local abrasion of the resin member.

The above-mentioned abrasion in the sliding mechanism leads to much play in the parts and causes a problem of occurrence of abnormal vibration and abnormal noise during operation of the fluid apparatus. In the case of the movable sealing unit, which provides the sealing function, while sliding, even a partial abrasion may lead to leak of fluid, thus failing to achieve the functions. Accordingly, the above-mentioned local abrasion impairs reliability of the fluid machinery provided with such a sealing structure.

With respect to measures to solve the defects or inconveniences mentioned above, there have been measures of (a) converting the shape of the resin-formed member of the sealing unit into a shape, which is flexibly deformable, in order to prevent the contact surface pressure from being increased locally and (b) smoothing the surface of the metallic member into a predetermined surface roughness in order to prevent the resin member from being abraded by the metallic member.

However, the measures (a) makes the structure complicated and degrades degree of freedom in design, thus causing the other problem of deterioration in an assembling operation. On the other hand, the measures (b) cause the other problems of difficulty in working and lack of productivity.

In addition, in a sliding motion between the fluorocarbon resin member and the metallic member, there may occur a phenomenon that even a sufficiently smooth surface may promote abrasion and does not always provide an abrasion prevention effect, thus being inconvenient.

These defects will be described hereunder, taking an example of the sliding motion between the fluorocarbon resin member and the metallic member.

In general, the fluorocarbon resin has the characteristic properties, i.e., a low-friction property and a low-abrasion property in the sliding motion in which no lubricant oil is supplied. Because the fluorocarbon resin has the strongest covalent bond (binding) in constituent atoms in comparison with the other kind of resin, with the result that the fluorocarbon resin is the most chemically stable compound, thus providing a low surface energy, an attractive force relative to the counterpart on the contact surface is small in a microscopic observation, thus leading to a low friction in the sliding motion in a macroscopic observation, and an amount of heat generated by the sliding motion is small, thus eliminating degradation of functions of the sliding mechanism.

However, the actual area contacting the counterpart during the sliding motion increases, according as the surface of the metallic member becomes smoother. Accordingly, an amount of heat generated by friction may increase even in the sliding motion between the fluorocarbon resin member and the metallic member, thus deteriorating the strength of the structural components (i.e., the occurrence of softening and a local fusion in some instances) and resulting in development of abrasion of the fluorocarbon resin member.

Another mechanism indicative of the low abrasion in the sliding motion between the fluorocarbon resin member and the metallic member is that a portion of the fluorocarbon resin migrates onto the surface of the counterpart, i.e., the metallic member so that both the sliding surfaces are formed of fluorocarbon resin in a macroscopic observation, thus forming the stable sliding surfaces and providing a stable abrasion property at low level, as shown in FIGS. 14A and 14B. However, in the case where the metallic member has an excessively large surface roughness, a sufficient amount of abrasion of the fluorocarbon resin, with which the irregularities of the metallic member are filled, causes the occurrence of leak in the sealing structure, thus providing an unfavorable result. In the case where the metallic member has an excessively small surface roughness, there cannot be ensured a function of anchoring the migrated portion of the fluorocarbon resin on the metallic member. More specifically, there cannot be obtained a sufficient contact strength by which the migrated portion of the fluorocarbon resin can be held on the surface of the metallic member. Accordingly, the development of abrasion cannot be avoided. After all, setting the surface roughness of the metallic member to any value makes it impossible to achieve an excellent abrasion property, thus causing problems.

SUMMARY OF THE INVENTION

An object of the present invention, which was made in view of the above-described circumstances, is therefore to provide a fluid machinery, which has a long service life and a high reliability, and reduces the number of the operation of replacing the sliding mechanism or permits to use such a mechanism as it is, without replacing it, thus remarkably decreasing a running cost of the fluid machinery.

The above and other objects can be achieved according to the present invention by providing a fluid machinery including a sliding mechanism comprising one side member composed, in combination, of a metallic base member having a sliding surface and a lubrication film formed on the sliding surface in a close contact thereto, and a counterpart side member containing fluorocarbon resin in an amount of at least 50 wt. %, the lubrication film including a solid lubricant having a self-lubrication property and a binder of resin material.

According to this aspect, the fluid machinery provides a long service life and a high reliability and reduces the number of the operation of replacing the sliding mechanism or permits to use such a mechanism as it is, without replacing it, thus remarkably decreasing a running cost of the fluid machinery.

In a preferable example, the resin material for the binder may comprise epoxy resin or polyamideimide resin. According to such example, the resin material for the binder provides an excellent adhesiveness to the base member, thus preventing the lubrication film from being easily peeled from the base member, an excellent heat resistant property, thus avoiding deterioration in quality of the lubrication film due to the friction heat, a high mechanical strength in itself and a high wear resistant property in itself, with the result that the sliding mechanism having a high reliability can be realized.

In another preferable example, the solid lubricant may contain at least one selected from the group consisting of graphite, molybdenum disulfide, boron nitride, antimony oxide and mica. According to such an optional feature, a constituent has a laminar crystal structure in itself in which the sliding motion occurs between the adjacent layers, thus providing the solid lubricant effects. In addition, the solid lubricant has a low attacking property of abrading the counterpart member. The sliding mechanism having a high reliability can therefore be realized.

In another preferable example, the metallic base member may be formed of aluminum alloy. According to such an optional feature, it is possible to provide weight reduction of equipment including the fluid machinery. In addition, the base member has a high thermal conductivity, thus making it possible to radiate effectively the friction heat generated in the sliding mechanism and prevent effectively a severe abrasion due to generation of heat in the sliding mechanism. The reliability of the fluid machinery can therefore be improved. The aluminum alloy may have a Rockwell hardness of at least 60. Furthermore, a hard film, which is formed of any one of alloy materials of Ni—P, Ni—B and Ni—P—B having a nickel content of at least 80 wt. %, may be provided between the metallic base member of the aluminum alloy and the lubrication film containing the solid lubricant. According to such features, the strength of the base member can be ensured, thus preventing the occurrence of abnormal vibration and abnormal noise, and the occurrence of leak in the sealing structure. In addition, it may become possible to increase remarkably the strength of at least a portion of the base member, in the vicinity of which the film is formed, and prevent the base member from being dented due to the contact surface pressure in the sliding motion, thus achieving a high reliability of the apparatus.

In another preferable example, the counterpart side member may constitute a sealing member on a movable member side and is composed of the fluorocarbon resin of 50 wt. % and the balance including either one of fiber reinforced material and a filling material, which may be an organic material. According to such a feature, it is possible to prevent the movable sealing unit from being deformed. In addition, the wettability resistant property and the thermal conductivity can be improved so as to decrease the temperature of the sliding mechanism, thus eliminating abrasion. Further, imparting the sliding property to the counterpart makes it possible to improve the wear resistant property. As a result, the sliding mechanism having the higher reliability and the long service life can be realized. Furthermore, the strength of the material such as the fluorocarbon resin can be enhanced. In addition, such a filling material has a low attacking property against the counterpart (i.e., the roller base member), thus making it possible to keep the abrasion of the counterpart at the minimum and control the abrasion of the filling material itself.

In another preferable example, the sliding mechanism may be operated under a condition in which no lubricant oil is supplied. According to this feature, the lubrication function can be provided effectively even in the severe circumstances in which no lubricant oil is supplied. Application of the present invention to the fluid machinery, which is especially used under a clean condition to which contamination of the lubricant oil is hostile, can provide the excellent performance and the high reliability of the apparatus.

In another preferable example, the sliding mechanism may comprise a movable seal slidable in contact to a component of the fluid machinery to provide a sealing function. Thus, the fluid machinery having the longer service life and the high reliability can be provided.

In another aspect of the present invention, there is provided a fluid machinery including a helical compression mechanism and an Oldham ring constituting a revolution prevention mechanism, the Oldham ring comprising a ring member formed of metallic material and a member mounted on the ring member to be slidable with respect to a counterpart member, the key member being formed of resin material containing fluorocarbon resin of at least 50 wt. %, and the counterpart member comprises a metallic base member having a sliding surface and a lubrication film formed on the sliding surface in a close contact thereto, the lubrication film comprising a solid lubricant having a self-lubrication property and a binder of resin material.

According to this aspect, the fluid machinery can provides a service life and a high reliability and reduces the number of the operation of replacing the sliding mechanism or permits to use such a mechanism as it is, without replacing it, thus remarkably decreasing a running cost of the fluid machinery.

In a preferable example of this aspect, the key member may be mounted on the ring member by a fitting pin, which has a head portion, a support portion and an insertion portion, the key member having a through-hole into which the fitting pin is inserted, and the key member having a length longer than that of the support portion of the fitting pin. Accordingly, it becomes possible to surely mount the key member on the ring member by the fitting pin having the support portion with high accuracy, through the use of the elastic deformation of the key member.

In a further preferable example, the key member may have a receiving surface on which the counterpart slides in a contact state, and the key member may be formed by grinding a blank key member having a rough dimension, which is provided on the ring member, into a predetermined dimension. Therefore, it is possible to mount stably the key member on the ring member, and it is also possible to improve the dimensional precision of the key member, and the positional precision thereof in the vertical and horizontal directions. The resin material for the key member has a low resistance to the grinding operation and a quantity of heat generated by such an operation is accordingly small, thus facilitating the formation of the key member. The precise position and dimensions of the key member can be provided without needing a high precision in not only the key member, but also any one of the ring member and fastening members, as well as in an assembling operation for these components. Accordingly, the costs can be reduced and a high productivity can be provided.

Furthermore, in a more specified embodiment, the present invention provide a fluid compressor as a fluid machinery comprising:

a helical mechanism constituting a helical compressor including a cylinder in which a sliding mechanism comprising a roller and a helical blade is arranged;

a driving unit operatively connected to the helical compressor to drive the same; and an Oldham ring provided for preventing a revolution of the roller of the sliding mechanism, wherein the sliding mechanism comprises one side member composed, in combination, of a metallic base member having a sliding surface and a lubrication film formed on the sliding surface in a close contact thereto, and a counterpart side member containing fluorocarbon resin in an amount of at least 50 wt. %, and the lubrication film including a solid lubricant having a self-lubrication property and a binder of resin material.

According to this embodiment, substantially the same functions and/or effects mentioned above will be attained.

The nature and further characteristic features may be made more clear from the following descriptions made with reference to the accompanying drawings.

DESCRIPTION OF THE PREFERRED EMBODIMENTS

Embodiments of a fluid machinery according to the present invention will be described in detail hereunder with reference to the accompanying drawings.

Figure 1:
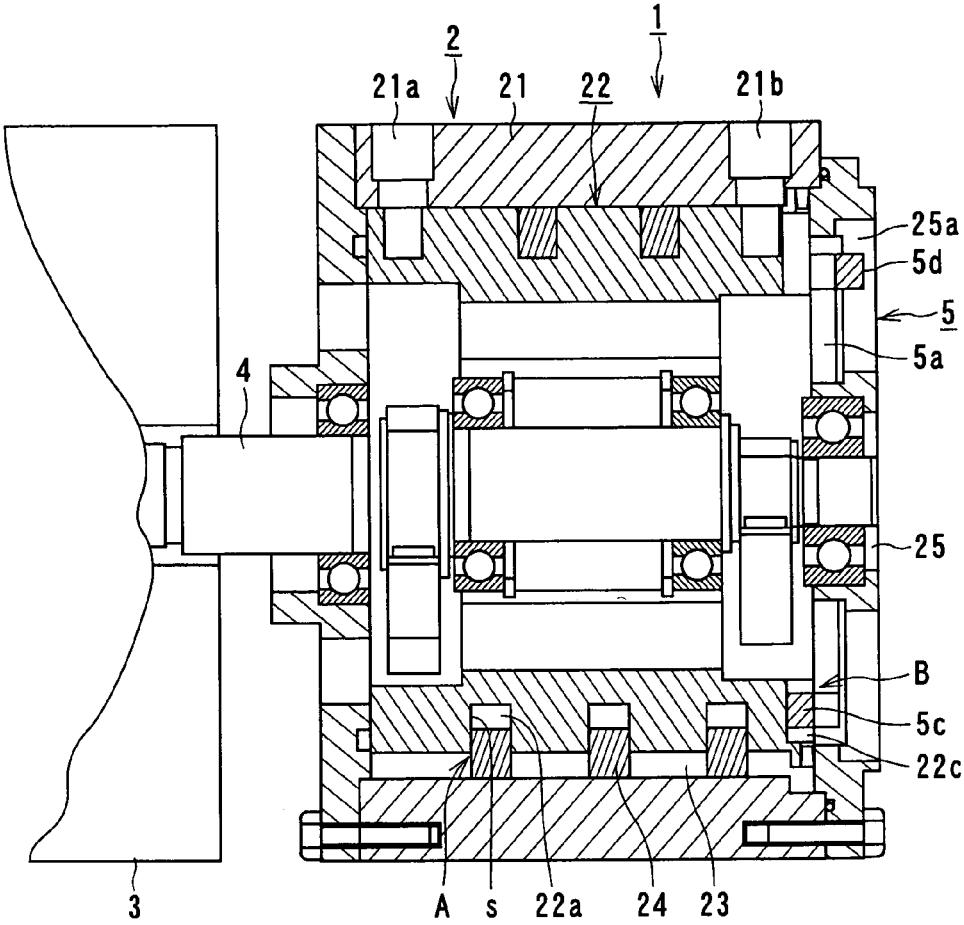
FIG. 1 is a cross-sectional view illustrating an embodiment of a fluid machinery according to the present invention.

FIG. 1 is a cross-sectional view illustrating the first embodiment of the fluid machinery, i.e., a horizontal helical compressor to which the present invention is applicable.

As shown in FIG. 1, a helical compressor 1 is shown as typical one example of the fluid machinery of the present invention. The helical compressor 1 is designed in the form of a casing-less type compressor, includes: a helical compression unit 2 serving as a helical compressing mechanism; a driving unit 3 for driving the helical compression unit 2; a crankshaft 4 extending from the driving unit 3 to the helical compression unit 2 to transmit the power of the driving unit 3 to the helical compression unit 2; and an Oldham ring 5 serving as a revolution prevention mechanism, which prevents a roller 22 of the helical compression unit 2 from rotating in itself.

The above-mentioned helical compression unit 2 includes a tubular roller 22 serving as a movable member, which is placed in a cylinder 21 serving as a stationary member so as to be capable of revolving eccentrically relative to the cylinder 21 and also includes a helical blade 24 that has an irregular pitch and defines compression chambers 23, which are formed between the roller 22 and the cylinder 21 so that the capacities of the compression chambers become gradually smaller from one side to the other side in the axial direction of the cylinder 21. The roller 22 is provided on its outer peripheral surface with a helical groove 22*a* formed thereon with a predetermined width so that the pitch of the helical groove 22*a* becomes gradually smaller from the side of an inlet port 21*a* placed on the left-hand side in FIG. 1 to the other side of an outlet port 21*b* placed on the right-hand side in the figure.

The helical blade 24 having resiliency is fitted into the above-mentioned helical groove 22*a* so as to be projected from the groove 22*a* or retracted therein.

Figure 2:
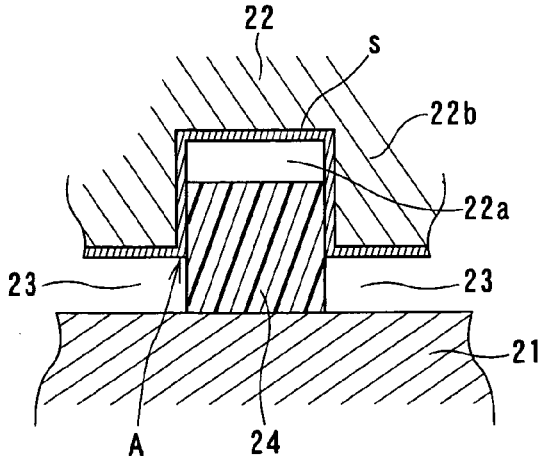
FIG. 2 is a cross-sectional view illustrating one example of a sliding mechanism provided for the fluid machinery of FIG. 1 according to the present invention.

As shown in FIGS. 1 and 2, the helical compressor 1 has a sliding mechanism "A", which is composed of combination of the roller 22 serving as a part or member on one side and the helical blade 24 serving as a counterpart, i.e., a member on the other side. Such a sliding mechanism "A" constitutes a movable sealing unit, which attains a sealing function, while coming into contact with the cylinder 21.

The roller 22 is composed of a metallic base member, e.g., an aluminum alloy roller base member 22*b* having a tubular shape, and a lubrication film "s" that serves as a sliding surface and contains a solid lubricant having a self-lubrication property and a binder of resin material. Forming the metallic base member of the aluminum alloy makes it possible to provide weight reduction of the helical compressor 1. In addition, the base member has a high thermal conductivity, thus making it possible to effectively radiate the friction heat generated in the sliding mechanism and effectively prevent a severe abrasion due to generation of heat in the sliding mechanism. The reliability of the fluid machinery can therefore be improved.

The aluminum alloy roller base member 22*b* preferably has the Rockwell hardness of at least 60. According to such an optional feature, the strength of the base member 22*b* can be ensured, thus preventing the occurrence of abnormal vibration and abnormal noise, and the occurrence of leak in the sealing structure. With the Rockwell hardness of smaller than 60, the base member 22*b* becomes too soft, resulting in possibility that the base member 22*b* may be dented by the contact surface pressure in the sliding motion, even when the sliding surface is not abraded. As a result, the same problem as in the abrasion occurs, and more specifically, abnormal vibration and abnormal noise occur due to much play in the parts and leak also occurs in the sealing structure.

The above-mentioned resin material for the binder preferably comprises epoxy resin or polyamideimide resin. According to such an optional feature, any one of such resin materials for the binder has (i) an excellent adhesiveness to the base member, thus preventing the lubrication film from being easily peeled from the base member, (ii) an excellent heat resistant property, thus avoiding deterioration in quality of the lubrication film due to the friction heat, (iii) a high mechanical strength in itself and (iv) a high wear resistant property in itself, with the result that the sliding mechanism having a high reliability can be realized.

The above-mentioned solid lubricant preferably contains at least one selected from the group consisting of graphite, molybdenum disulfide, boron nitride, antimony oxide and mica. According to such an optional feature, such constituent provides a laminar crystal structure in itself in which the sliding motion occurs between the adjacent layers, thus providing the solid lubricant effects. In addition, the solid lubricant has a low attacking property of abrading the counterpart. The sliding mechanism having a high reliability can therefore be realized.

The counterpart, which serves as the helical blade 24, is preferably composed of the fluorocarbon resin of 50 wt. % and the balance being any one of fiber reinforced material and a filling material. According to such an optional feature, it is possible to prevent the helical blade 24 from being deformed. In addition, the wettability resistant property and the thermal conductivity can be improved so as to decrease the temperature of the sliding mechanism, thus eliminating abrasion. Further, imparting the sliding property to the counterpart makes it possible to improve the wear resistant property. As a result, the sliding mechanism having the improved high reliability and the long service life can be realized. Polytetrafluoroethylene resin, perfluoroethylene propylene resin, perfluoroalkoxy resin, ethylene-tetrafluoroethylene resin, vinylidenefluoride resin, vinylfluoride resin, chlorotrifluoroethylene resin or ethylene-chlorotrifluoroethylene resin is used as the above-mentioned fluorocarbon resin.

As the above-mentioned fiber reinforced material, there may be used an Organic fiber such as aromatic polyimide fiber and aramid fiber; inorganic fiber such as carbon fiber, glass fiber, graphite fiber, wollastonite, whisker (potassium titanate, carbon, silicon carbide, sapphire), steel wire, copper wire and stainless wire; boron fiber; silicon carbide fiber; or the other composite fiber.

The filling material or filler may preferably be organic. According to such an optional feature, the strength of the material such as the fluorocarbon resin can be enhanced. In addition, such a filling material has a low attacking property against the counterpart (i.e., the roller base member), thus making it possible to keep the abrasion of the counterpart at the minimum and control the abrasion of the filling material itself. The organic matter such as aromatic polyetherketone resin, polyimide resin, polyamideimide resin, polyetherimide resin, polyethersulfon resin, heat-resistant polyamide resin, phenol resin, aromatic polyester resin and polyphenylenesulfide resin may preferably be used as the filling material. Alternatively, as the filling material or filler, there may be used a metal such as aluminum, magnesium and zinc and oxide thereof; heat conductivity improving organic powder such as bronze; lubrication improving inorganic material such as glass beads, silica balloon, diatomaceous earth, magnesium carbonate, mica, talc, molybdenum disulfide, tungsten disulfide, boron nitride, silicon carbide, silicon nitride, phosphate, iron oxide, graphite and carbon black; or internal lubrication additive such as silicone oil, ester oil, wax and zinc stearate.

Figure 3:
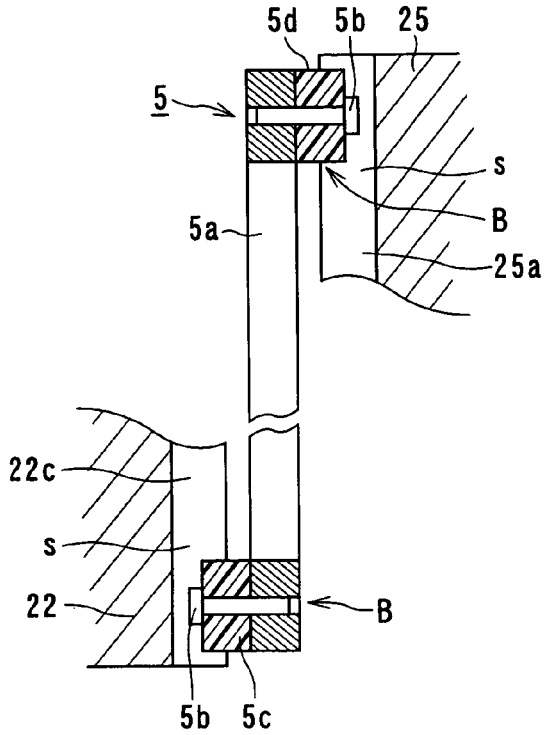
FIG. 3 is a cross-sectional view illustrating another example of a sliding mechanism provided for the fluid machinery.
Figure 4:
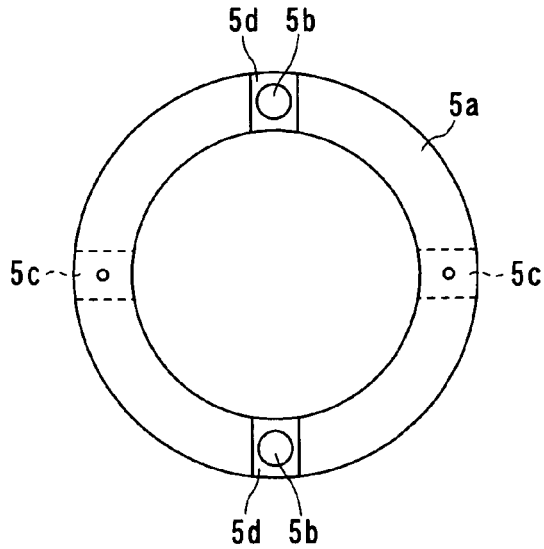
FIG. 4 is a plan view illustrating an Oldham ring used in the fluid machinery according to the present invention.
Figure 5:
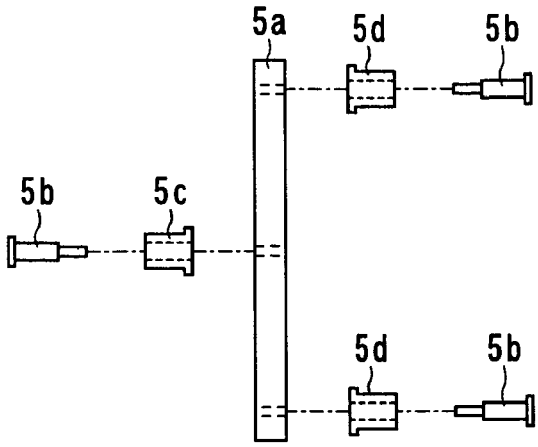
FIG. 5 is an exploded view of the Oldham ring used in the fluid machinery according to the present invention.
Figure 6:
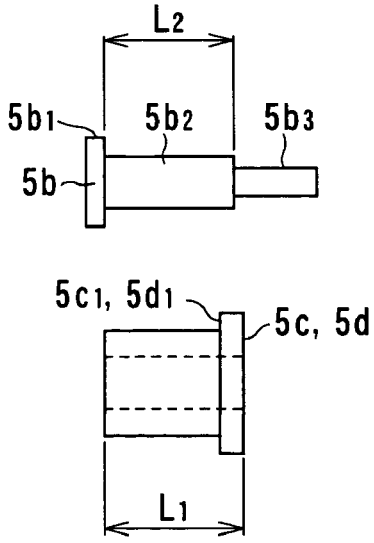
FIG. 6 is a side view illustrating a fitting pin and a key member used in the Oldham ring of the fluid machinery according to the present invention.

As shown in FIGS. 3 to 5, the Oldham ring 5 includes a ring member 5*a* and key members 5*c*, 5*d*. The ring member 5*a* is formed of metallic material such as for example aluminum alloy. Each of the key members 5*c*, 5*d* is formed of resin material containing fluorocarbon resin of at least 50 wt. % into a separate body having a shape of rectangular parallelepiped. Each of the key members 5*c*, 5*d* is mounted on the ring member 5*a* by means of a fitting pin 5*b*. The ring member 5*a*, which is formed of the aluminum alloy, has a weight lighter than iron or stainless material and a function of damping oscillation. As shown in FIG. 6, the key members 5*c*, 5*d* have receiving surfaces $5c_1$, $5d_1$, respectively. The fitting pin 5*b* has a head portion $5b_1$, a support portion $5b_2$ and an insertion portion $5b_3$. The above-mentioned key member 5*c*, 5*d* has a length "L1", which is longer than the length "L2" of the support portion $5b_2$ of the fitting pin 5*b*. Such a structure enables the key member 5*c*, 5*d* to be mounted surely on the ring member 5*a* with high accuracy by means of the fitting pin 5*b* having the support portion $5b_2$ formed thereon, through the use of the elastic deformation of the key member 5*c*, 5*d*. However, the difference of the length "L1" from the length "L2" is too large to the extent that the key members 5*c*, 5*d* are subjected to compression beyond the range of the elastic deformation, with the result that a excessively severe deformation of the key members 5*c*, 5*d* may cause inappropriate dimensions thereof, and the plastic deformation may occur to degrade the fitting force, thus providing unfavorable matter.

Figure 7A:
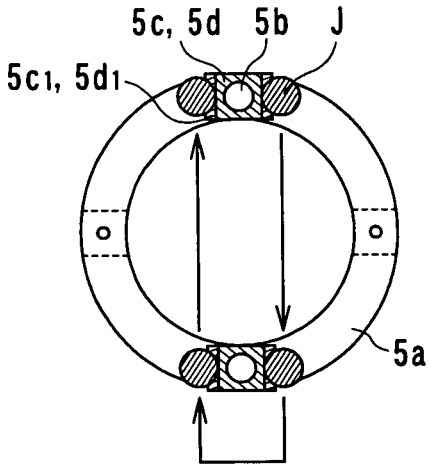
FIGS. 7A and 7B are schematic descriptive views illustrating a forming process of a receiving surface of the key member used in the Oldham ring of the fluid machinery according to the present invention.
Figure 7B:
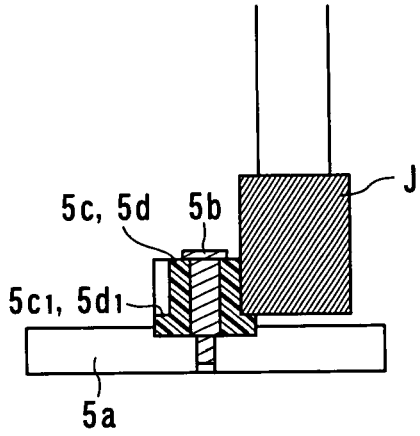

As shown in FIG. 7, the receiving surface $5c_1$, $5d_1$ of the key member 5*c*, 5*d* is preferably formed by grinding a blank key member, which has been mounted on the ring member 5*a* by the fitting pin 5*b*, with the use of a grinding tool "J". According to such a formation process, the key member 5*c*, 5*d* formed of the resin material containing fluorocarbon resin of at least 50 wt. % is ground, thus making it possible to improve the dimensional precision of the key member 5*c*, 5*d*, and the positional precision thereof in the vertical and horizontal directions.

In addition, the resin material for the key member 5*c*, 5*d* has a lower resistance to the grinding operation than the metallic material for the conventional key member, and a quantity of heat generated by such an operation is accordingly small, thus facilitating the formation of the key member 5*c*, 5*d*. Further, the grinding operation is carried out after the key member 5*c*, 5*d* is mounted on the ring member 5*a*, with the result that the precise position and dimensions of the key member 5*c*, 5*d* can be provided without needing a high precision in not only the key member 5*c*, 5*d*, but also any one of the ring member and fastening members, as well as in an assembling operation for these components. Accordingly, the costs can be reduced and a high productivity can be provided.

In a case where the fitting pin 5*b* is formed of the same material as the ring member 5*b*, for example of aluminum alloy, the stable fixing force to the ring member 5*a* can be ensured, without being affected by difference in thermal expansion between the fitting pin 5*b* and the ring member 5*a*.

In addition, application of an adhesive agent to the coupling portion of the ring member 5*a* and the fitting pin 5*b* makes it possible to prevent the fitting pin 5*b* from being loosened, thus providing a more stably improved fitting condition.

Figure 8:
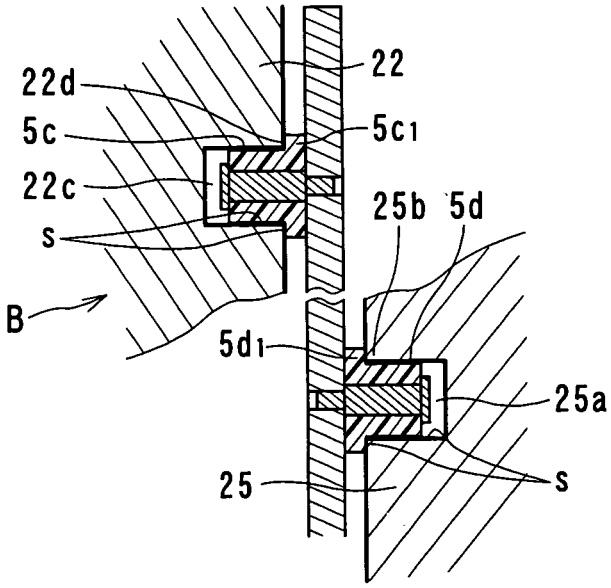
FIG. 8 is a cross-sectional view illustrating further another sliding mechanism provided for the fluid machinery according to the present invention.

As shown in FIG. 8, the key member 5*c* is slidably fitted into a key groove 22*c* formed on the roller 22 so that the receiving surface $5c_1$ abuts against the roller side-sliding surface 22*d*. On the other hand, the key member 5*d* is slidably fitted into a key groove 25*a* formed on a sub-bearing 25 so that the receiving surface $5d_1$ abuts against the sub-bearing side-sliding surface 25*d* of the sub-bearing 25. The sliding mechanism "B" is formed in this manner. Providing the receiving surface $5c_1$ and the receiving surface $5d_1$ can prevent the roller side-sliding surface 22*d* and the sub-bearing side-sliding surface 25*d* from coming into contact with the ring member 5*a*, so as to reduce sliding loss, thus providing a high sliding performance.

In addition, the lubrication film "s", which includes a binder of resin material and the solid lubricant having a self-lubrication property held in such a binder, is formed on the sliding surfaces of the metallic base members, i.e., the roller 22 and the sub-bearing 25, for example on the surface of the key groove 22*c* of the roller 2, the roller side-sliding surface 22*d*, the surface of the key groove 25*a* of the sub-bearing 25 and the sub-bearing side-sliding surface 25*b* thereof.

Figure 9:
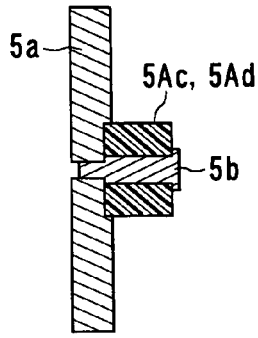
FIG. 9 is a cross-sectional view illustrating a modification of the fitting pin and the key member used in the Oldham ring of the fluid machinery.
Figure 10:
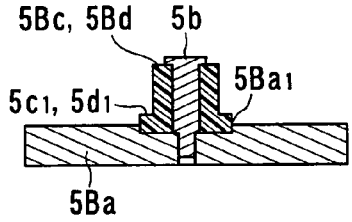
FIG. 10 is cross-sectional view illustrating another modification of the fitting pin and the key member used in the Oldham ring of the fluid machinery according to the present invention.

As shown in FIG. 9, each of the key members 5Ac, 5Ad may be formed into a shape of rectangular parallelepiped having no receiving surface. Alternatively, as shown in FIG. 10, there may be adopted a structure in which the ring member 5Ba has a recess $5Ba_1$ formed thereon and a part of the key member 5Bc, 5Bd is fitted into the recess $5Ba_1$. Such a structure prevents the key member 5Ac, 5Ad from rotating around its central axis, with the result that the key member 5Ac, 5Ad can bear a large torque, and the loosening of the key member 5Ac, 5Ad can also be avoided, thus providing a high reliability.

Figure 11:
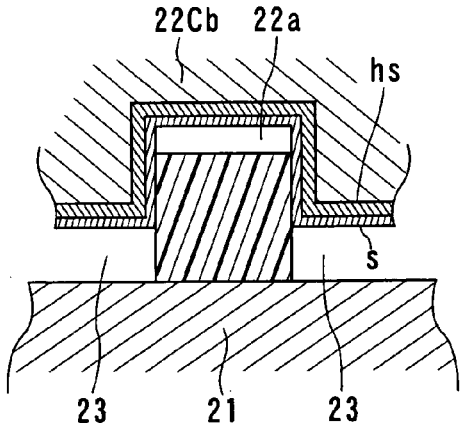
FIG. 11 is a cross-sectional view illustrating a modification of the sliding mechanism provided in the fluid machinery according to the present invention.
Figure 12A:
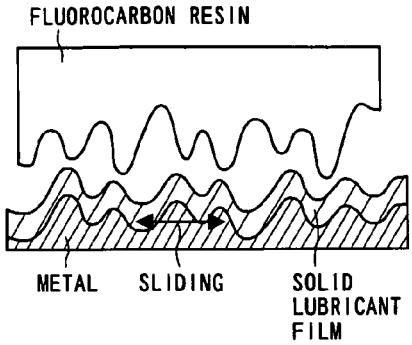
FIGS. 12A and 12B are views conceptually illustrating a state in which the sliding mechanism provided for the fluid machinery is subjected to abrasion.
Figure 12B:
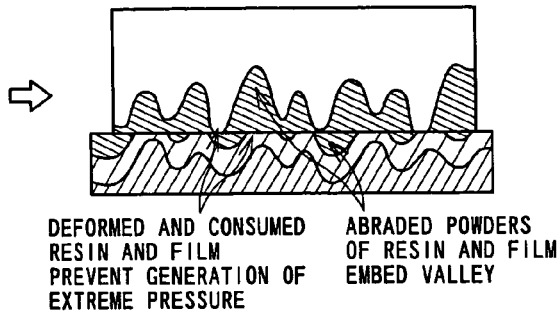

As shown in FIG. 11, a hard film "hs", which is formed of any one of alloy materials of Ni—P, Ni—B and Ni—P—B having a nickel content of at least 80 wt. %, is formed between the aluminum alloy base member and the lubrication film "s" containing the solid lubricant. This makes it possible, though the sliding surface being not abraded, to remarkably increase the strength of at least a portion of the base member, in the vicinity of which the film is formed, and prevent the occurrence of the problem that the base member is dented due to the contact surface pressure in the sliding motion, thus achieving a high reliability of the fluid machinery. When the base member is too soft, resulting in possibility that the base member may be dented by the contact surface pressure in the sliding motion, even when the sliding surface is not abraded.

As a result, the same problem as in the abrasion occurs, and more specifically, abnormal vibration and abnormal noise occur due to much play in the parts and leak also occurs in the sealing structure.

Even if the lubrication film containing the solid lubricant is partially peeled off so that the sliding action occurs between the member of the Ni alloy and the member of the fluorocarbon resin, such a combination of sliding members has a relatively good wear resistance, which is however inferior to that of the combination of the lubrication film and the member of the fluorocarbon resin. Therefore, the sliding mechanism having a high reliability, which prevents development of abrasion at the worst, may be realized.

The sliding mechanism of the fluid machinery is described, taking the examples of the combination (i.e., the sliding mechanism "A") of the roller 22 and the helical blade 24, and the combination (i.e., the sliding mechanism "B") of the key member 5*c*, 5*d* of the Oldham ring 5 and the sub-bearing 25. The sliding mechanism of the present invention is not limited only to such combinations but may be applied to any movable sealing unit such as a combination of the blade and a cylinder, a combination of a thrust seal and a bearing and a combination of the thrust seal and the roller. In addition, the present invention is not limited only to the compressor, but may be applied to a vacuum pump, or a scrolling type fluid machinery, a rotary type fluid machinery and a reciprocating type fluid machinery.

A method of compressing refrigerant with the use of the fluid machinery according to the present invention will be described hereunder.

The driving unit 3 of the helical compressor 1 is driven to revolve the roller 22 eccentrically relative to the cylinder 21 through the crankshaft 4, as shown in FIG. 1. Then, the roller 22 eccentrically revolves, while coming into contact to the inner peripheral surface of the cylinder 21. Such an eccentric revolution of the roller 22 causes the compression chambers, which are defined by the cylinder 21, the roller 22 and the helical blade 24, to helically move so that the capacities of the compression chambers become gradually smaller from one side to the other side in the axial direction of the cylinder 21. Such variation in capacity of the compression chambers 23 enables the refrigerant sucked through the inlet port 21*a* to be compressed sequentially into a high pressure. The refrigerant thus compressed is discharged from the outlet port 21*b*.

In such a compression process, the sliding mechanism "A" is composed of one part, i.e., the roller 22 and the counterpart, i.e., the helical blade 24 of the other part. The sliding mechanism "A" constitutes the movable sealing unit, which provides the sealing function, while coming into contact to the cylinder 21. The sliding surface of the cylinder 21 has the lubrication film "s", which includes the binder of resin material and the solid lubricant having the self-lubrication property held in such a binder. On the other hand, the roller 22 contains the fluorocarbon resin of at least 50 wt. %. Accordingly, both of the sliding surfaces of the cylinder 21 and the roller 22 have the self-lubrication property and a low rigidity. A relatively high surface pressure, which locally occurs due to inconsistency in shape of the part and the counterpart, can be reduced by an initial slight deformation of the surfaces of the part and the counterpart and the subsequent rapid abrasion of portions having a high surface pressure of the part and the counterpart.

As shown in FIGS. 1 and 8, the sliding mechanism "B" is composed of the parts, i.e., the roller 22 and the sub-bearing 25, and the counterpart, i.e., the key members 5*c*, 5*d*. The lubrication film "s" is formed on the sliding surfaces of the metallic base members, more specifically on the surface of the key groove 22*c* of the roller 2, the roller side-sliding surface 22*d*, the surface of the key groove 25*a* of the sub-bearing 25 and the sub-bearing side-sliding surface 25*b* thereof. A relatively high surface pressure, which locally occurs due to inconsistency in shape of the part and the counterpart, can be reduced by an initial slight deformation of the surfaces of the part and the counterpart and the subsequent rapid abrasion of portions having a high surface pressure of the part and the counterpart.

In the sliding mechanism of the present invention, both of the part and the counterpart are deformable, and the above-mentioned surface pressure reduction effect utilizing the deformation of the sliding mechanism can be remarkably improved in comparison with the conventional sliding mechanism in which the metallic part is combined with the resin counterpart that is deformable and has a low rigidity.

With respect to the function of abrading the portion having the high surface pressure of the sliding mechanism to provide a stable sliding condition, the sliding action occurs between the resin parts of the sliding mechanism in the present invention, both of these parts may abrade rapidly to provide a stable sliding condition, in comparison with the conventional sliding mechanism in which the combination of the metallic part and the resin part is used, and only the resin part having the low rigidity is permitted to abrade.

In the present invention, both the parts (one and its counterpart members) have the self-lubrication property, thus maintaining a low coefficient of friction. As a result, there can be provide effects of preventing the occurrence of severe abrasion, which has been caused in the conventional sliding mechanism, due to heat generated therein by the local high pressure surface or a high coefficient of friction, to control the occurrence of abnormal abrasion.

In addition, there occurs a phenomenon to fill concavities of the surfaces of both the parts having the initial surface roughness with abraded powdery materials of these parts in a small amount, so that the thus abraded powdery materials migrates onto both the parts, while causing these powdery materials in the sliding surfaces. It is therefore possible to provide a stable sliding condition, with a remarkably reduced amount of abrasion of the parts in comparison with the combination of the metallic part and the resin part in the conventional sliding mechanism.

It is therefore possible to provide the stable sliding surfaces of the parts, with a small amount of abrasion thereof, thus maintaining the sliding condition in which almost no development of abrasion occurs apparently.

As a result, there can be realized the fluid machinery such as a compressor and a vacuum pump, provided with a sealing mechanism having a high reliability. In addition, the friction is small during the initial operation, with the result that the operation loss of the equipment can be kept small in a stable manner, thus realizing the fluid machinery having a high performance. In the case where the sliding mechanism serves as the sealing unit, it is possible to provide the fluid machinery, which has a long service life and a high reliability, and reduces the number of the operation of replacing the sliding mechanism or permits to use such a mechanism as it is, without replacing it, thus remarkably decreasing a running cost of the fluid machinery.

In the fluid machinery according to the above-described embodiment of the present invention, the sliding mechanism is operated under the condition in which no lubricant oil is supplied. More specifically, according to the present invention, an effective lubrication function can be provided even under such a condition in which no lubricant oil is supplied. Accordingly, application of the present invention to a high performance compressor or vacuum pump, which is especially used under a clean condition to which contamination of the lubricant oil is hostile, can provide the excellent performance and the high reliability of the apparatus.

EXAMPLE

There were carried out operation tests for the helical compressor as shown in FIG. 1, as one example of a fluid machinery of the present invention, and the conventional helical compressors as comparative examples, to determine an amount of abrasion of the blade.

The compressors had the sliding mechanisms serving as the movable sealing units, which were provided with the blades and the rollers formed of the materials described below:

Example of the Present Invention (1) Blade being formed of perfluoroalkoxy resin (PFA) to which polyimide resin was added in an amount of up to 50 wt. %

(2) Roller being composed of the aluminum base member having a Rockwell hardness of 60, an electroless plated Ni—P layer formed on the aluminum base member and a film, which was formed on the Ni—P layer and contained polyamide resin and $MoS_2$ serving as the binder

Comparative Example 1

(1) Blade being formed of perfluoroalkoxy propylene resin (PFA) to which glass fiber was added in an amount of up to 50 wt. %

(2) Roller being formed of aluminum having a Rockwell hardness of 60

Comparative Example 2

(1) Blade being formed of PFA to which polyimide resin was added in an amount of up to 50 wt. %

Figure 13:
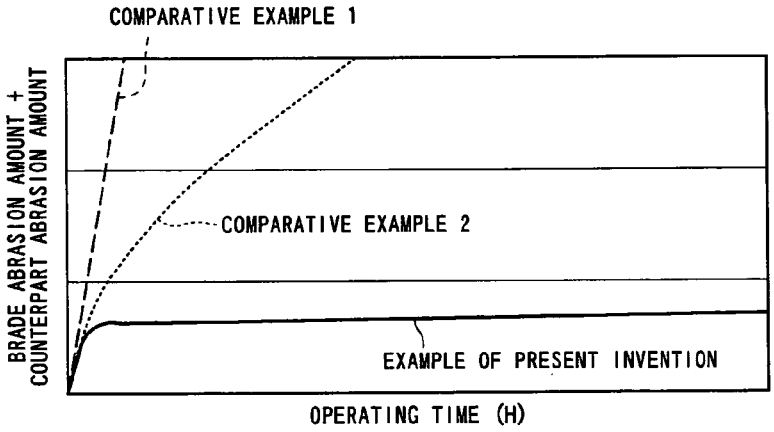
FIG. 13 is a graph showing results of an abrasion test of a blade of the fluid machinery is subjected to abrasion.
Figure 14A:
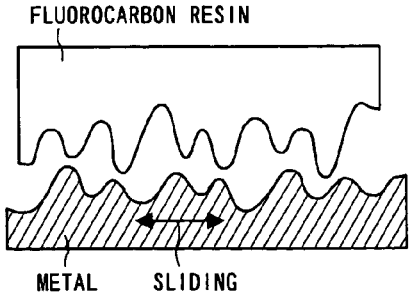
FIGS. 14A and 14B are views conceptually illustrating a state in which the sliding mechanism provided in the conventional fluid machinery.
Figure 14B:
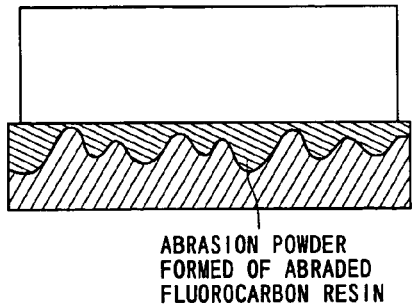

(2) Roller being composed of the aluminum base member having a Rockwell hardness of 60 and an electroless plated Ni—P layer formed on the aluminum base member As is clear from the graph of FIG. 13, showing test results, it was recognized that, in the Example of the present invention, the conformable abrasion merely occurred at the initial stage and then the state in which almost no development of abrasion occurred was maintained.

On the contrary, it was recognized that, in the Comparative Example 1, the rapid development of abrasion occurred in a very small period of time. It was also recognized that, in the Comparative Example 2, the combination of the blade and the roller provided the lubrication improving effects in a certain extent, the development of abrasion occurred, although the amount of abrasion was smaller than the Comparative Example 1, thus providing the performance only in a limited service life.

According to the present invention, it is possible to provide the fluid machinery, which has a long service life and a high reliability, and reduces the number of the operation of replacing the sliding mechanism or permits to use such a mechanism as it is, without replacing it, thus remarkably decreasing a running cost of the fluid machinery.

Further, it is to be noted that the present invention is not limited to the described embodiments and many other changes and modifications may be adopted without departing from the scopes of the appended claims.

What is claimed is:

1. A fluid machinery including a sliding mechanism comprising one side member composed, in combination, of a metallic base member having a sliding surface and a lubrication film formed on the sliding surface in a close contact thereto, and a counterpart side member containing fluorocarbon resin in an amount of at least 50 wt. %, said lubrication film including a solid lubricant having a self-lubrication property and a binder of resin material, wherein said metallic base member is formed of aluminum alloy and a hard film, which is formed of any one of alloy materials of Ni—P, Ni—B and Ni—P—B having a nickel content of at least 80 wt. %, is applied to a portion between the metallic base member of the aluminum alloy and the lubrication film containing the solid lubricant.

2. A fluid machinery according to claim 1, wherein said resin material for the binder comprises epoxy resin.

3. A fluid machinery according to claim 1, wherein said resin material for the binder comprises polyamideimide resin.

4. A fluid machinery according to claim 1, wherein said solid lubricant contains at least one selected from the group consisting of graphite, molybdenum disulfide, boron nitride, antimony oxide and mica.

5. A fluid machinery according to claim 1, wherein said aluminum alloy has a Rockwell hardness of at least 60.

6. A fluid machinery according to claim 1, wherein said sliding mechanism is operated under a condition without lubricant oil supply.

7. A fluid machinery according to claim 1, wherein said sliding mechanism comprises a movable seal unit slidable in contact to a component of the fluid machinery so as to provide a sealing function.

8. A fluid machinery including a sliding mechanism comprising one side member composed, in combination, of a metallic base member having a sliding surface and a lubrication film formed on the sliding surface in a close contact thereto, and a counterpart side member containing fluorocarbon resin in an amount of at least 50 wt. %, said lubrication film including a solid lubricant having a self-lubrication property and a binder of resin material, wherein said metallic base member is formed of aluminum alloy, and said counterpart side member constitutes a sealing unit on a movable member side and is composed of the fluorocarbon resin of 50 wt. % and a balance including either one of a fiber reinforced material and a filling material.

9. A fluid machinery according to claim 8, wherein said filling material is an organic material.

10. A fluid machinery according to claim 8, wherein said resin material for the binder comprises epoxy resin.

11. A fluid machinery according to claim 8, wherein said resin material for the binder comprises polyamideimide resin.

12. A fluid machinery according to claim 8, wherein said solid lubricant contains at least one selected from the group consisting of graphite, molybdenum disulfide, boron nitride, antimony oxide and mica.

13. A fluid machinery comprising:

a helical mechanism constituting a helical compressor including a cylinder in which a sliding mechanism comprising a roller and a helical blade is arranged;

a driving unit operatively connected to the helical compressor to drive the same; and an Oldham ring provided for preventing a revolution of the roller of the sliding mechanism, said sliding mechanism comprising one side member composed, in combination, of a metallic base member having a sliding surface and a lubrication film formed on the sliding surface in a close contact thereto, and a counterpart side member containing fluorocarbon resin in an amount of at least 50 wt. %, said lubrication film including a solid lubricant having a self-lubrication property and a binder of resin material and a hard film, which is formed of any one of alloy materials of Ni—P, Ni—B and Ni—P—B having a nickel content of at least 80 wt. %, is applied to a portion between the metallic base member of the aluminum alloy and the lubrication film containing the solid lubricant.

* * * * *